United States Patent [19]

Dykmans

[11] Patent Number: 4,776,145

[45] Date of Patent: Oct. 11, 1988

[54] MULTI PURPOSE DOME STRUCTURE AND THE CONSTRUCTION THEREOF

[76] Inventor: Max J. Dykmans, 1214 Pioneer Way, El Cajon, Calif. 92022-0696

[21] Appl. No.: 559,911

[22] Filed: Dec. 9, 1983

[51] Int. Cl.[4] ..... E04B 1/32

[52] U.S. Cl. ..... 52/741; 52/169.7; 52/223 L; 52/224; 52/249; 52/309.16; 52/309.17; 52/2; 264/34

[58] Field of Search ..... 52/2, 167, 223 R, 223 L, 52/245, 249, 80, 741, 309.12, 309.16, 309.17, 169.6, 224, 169.7; 264/32, 34, 35, 45.2

[56] References Cited

U.S. PATENT DOCUMENTS

| | | | |
|---|---|---|---|
| 2,388,701 | 11/1945 | Neff | 264/32 |
| 2,836,529 | 5/1958 | Morriss | 428/236 |
| 2,892,239 | 6/1959 | Neff | 264/32 |
| 3,277,219 | 10/1966 | Turner | 264/45.2 |
| 3,410,039 | 11/1968 | Brezina | 52/223 R |
| 3,504,474 | 4/1970 | Dykmans | 52/741 |
| 3,510,041 | 5/1970 | Dykmans | 226/172 |
| 3,572,596 | 3/1971 | Dykmans | 242/7.21 |
| 3,643,910 | 2/1972 | Heifetz | 249/65 |
| 3,666,189 | 5/1972 | Dykmans | 242/7.21 |
| 3,666,190 | 5/1972 | Dykmans | 242/7.21 |
| 3,824,751 | 7/1974 | Shelander | 52/173 R |
| 4,077,177 | 3/1978 | Boothroyd et al. | 264/32 |
| 4,126,976 | 11/1978 | Crowley | 52/224 |
| 4,155,967 | 5/1979 | South et al. | 264/32 |
| 4,170,093 | 10/1979 | Cappellini et al. | 264/35 |
| 4,271,647 | 6/1981 | Balck, Jr. | 52/167 |
| 4,302,978 | 12/1981 | Dykmans | 73/828 |
| 4,302,979 | 12/1981 | Dykmans | 73/828 |
| 4,365,455 | 12/1982 | Braine | 264/35 |
| 4,442,059 | 4/1984 | Boyce | 264/35 |
| 4,446,083 | 5/1984 | Nicholls | 264/34 |
| 4,550,544 | 11/1985 | Thoeny | 52/741 |

FOREIGN PATENT DOCUMENTS

| | | | |
|---|---|---|---|
| 559009 | 9/1977 | U.S.S.R. | 52/223 R |
| 776077 | 6/1957 | United Kingdom | 52/224 |
| 2092215A | 8/1982 | United Kingdom | 52/169.6 |

OTHER PUBLICATIONS

A four page pictorial publication brochure entitled: "Binishells Technology Pneumatically Formed Reinforced Concrete Structure", showing charts and schematics.

A two page brochure entitled "The Dyk Igloo—Tomorrows's Technology at Yesterday's Prices", first page shows photographs of tanks and includes descriptions, second page is a profile chart.

"AWWA Standard for Thermosetting Fiberglass—Reinforced Plastic Tanks", First Edition and Copyright 1984 by American Water Works Association, pp. i through iv and 1 through 17.

Cover pages and p. 31 from the "Engineering Data for Aluminum Structures", Third Edition, 1975 (Total—3 pages).

A Portion of the "Venus Products Catalog", Third Edition, cover page, and pp. 16–17, 20–21, 24–25 and 56–57.

2 Catalogs from the "Hercules" company, (14 pages total six pages from one eight pages from the other catalog).

2 Catalogs for the "KAB-O-RAP Company", (25

(List continued on next page.)

*Primary Examiner*—Carl D. Friedman
*Assistant Examiner*—Andrew Joseph Rudy
*Attorney, Agent, or Firm*—Lyon & Lyon

[57] ABSTRACT

An improved dome structure on a base is disclosed comprising of a membrane sandwiched between layers of rigidifying material such as shotcrete which also serve to embed the circumferential and radial prestressing members. Circumferential prestressing can be applied to minimize bursting stresses. Further layers of rigidifying material can then be applied over the circumferential prestressing as a final protection and cover. The radial prestressing materials can contain spacers or hooks to preclude the circumferential prestressing material from riding up on the structure. The lower portion of the dome can include a reverse curvature to minimize stresses and stabilize the structure.

52 Claims, 3 Drawing Sheets

OTHER PUBLICATIONS pages), (the first catalog having 15 pages, and the second 10 pages).

Brochure entitled "Tankinetics" copyrighted in 1975 by Justin Enterprises, Inc. (8 pages).

Max J. Dykmans; DYK-Phram Tanks, brochure pp. 1-4.

Max J. Dykmans; Automation in DYK P.C. Tanks, brochure—2 pages.

Max J. Dykmans; DYK-Phram Poured-in-Place Concrete Tank Walls, brochure—pp. 1-31.

Max J. Dykmans; DYK-Phram Precast Concrete, brochure pp. 1-22.

MULTI PURPOSE DOME STRUCTURE AND THE CONSTRUCTION THEREOF

BACKGROUND OF THE INVENTION

The field of the present invention is of dome structures and their construction which can be used to contain liquids, solids or gases or to provide temporary or permanent shelter, There has been a need for the facile construction of dome-type structures, as conventional construction of these structures has proven difficult and costly and the structures themselves have had problems with stability and leakage.

Certain of these conventional structures have utilized inflated membranes. Indeed, inflated membranes have been used for airport structures where the structure consists of the membrane itself. Inflated membranes have also been used to form concrete shells wherein a membrane is inflated, and used as a support form. Concrete is placed over the membrane and the membrane is removed after the concrete has hardened. Conventional systems called "Binishells" are systems of this type. These are constructed by placing metal springs and reinforcing over an uninflated lower membrane. Concrete is placed over the membrane and then the membrane is inflated while the concrete is still soft. An upper membrane is placed over the concrete to prevent it from sliding to the bottom as the inflation progresses. After the concrete has hardened the membranes are typically removed. Literature regarding "Binishells" technology is provided under cover of the disclosure statement submitted herewith.

SUMMARY OF INVENTION

The present invention is directed to axis-symmetrical, parabolic, round, elliptical or other similar structures that can be used to contain liquids, solids and/or gases and to provide temporary or permanent shelter. A membrane may be inflated to the desired shape against radial high-tensile prestressing or reinforcing elements. (These terms are used interchangeably as either prestressing or reinforcing members can be used to construct the claimed dome structures.) The interior and exterior of the inflated membrane is coated with a rigidifying material forming a structural composite layer with the membrane sandwiched in between.

In the construction, the radial elements may be fastened on one end to a base comprised of a circular footing, integral with or attached to with a floor, upon which the dome structure rests. Additional radial prestressing may be added as desired, with the prestressing elements optionally tensioned. Circumferential high-tensile prestressing elements may be applied around the structure to counteract the bursting force provided by the materials or liquids contained in the dome. Final rigidifying material may be applied over the circumferential prestressing or reinforcing as a final protection or cover.

In a further aspect of the present invention, a reverse (inward) curvature of the dome walls near the base may be employed where the dome is connected to the footing, which in many instances can be positioned below the surface of the ground (or backfill). When a circumferential prestressing force is applied to the dome, there is a tendency for the rigidifying material outside the membrane to be forced up along the membrane surface creating a separation between the rigidifying material and the membrane. The reverse curvature of the dome avoids this by providing an anchor for the radial prestressing on the dome surface itself. The upward forces acting above the point of largest diameter of the curvature are countered by the forces acting below that point of largest diameter.

Moreover, beside providing an anchor for radial reinforcing is the rigidifying material outside the membrane, the reverse (inward) curvature near the base of dome will also reduce the uplift caused by pressure from the contents of the dome, for example, by water pressure if the dome is used as a water tank.

Furthermore, the increased thickness of the rigidifying material at the base of the dome stiffens the structure against seismic, wind and other asymmetrical horizontal forces.

Finally, to minimize vertical bending stresses in the walls near the bottom of the dome, the dome walls are placed on resilient bearing pads to permit a free radial movement of the shell with respect to the base.

DETAILED DESCRIPTION OF THE PREFERRED EMBODIMENTS

Figure 1:
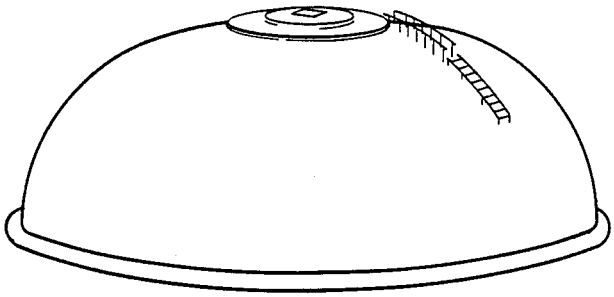
FIG. 1 is a perspective view of a finished dome structure.
Figure 2:
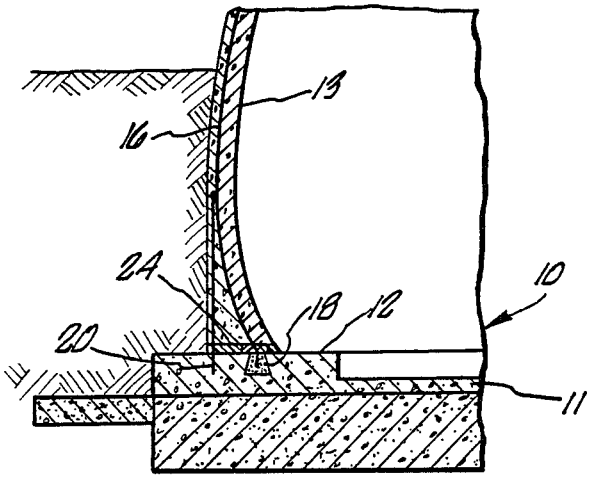
FIG. 2 is a cross-sectional view of a portion of an embodiment of the dome structure illustrating the connection between the base, footing and composite wall formed of the membrane sandwiched between layers of rigidifying material with prestressing embedded therein. This figure illustrates a preferred embodiment wherein the dome walls curve inwardly near the base of the dome to reduce uplift and otherwise stabilize the dome. The inwardly curved portion of the walls may be buried in the ground below the surface of the backfill.

Turning in detail to the drawings and particularly FIG. 1, a dome structure is disclosed for the containment of liquids, solids or gases, or to provide temporary of permanent shelter. The axis-symmetrical structure can be parabolic, round, elliptical or other similar shape. Turning more specifically to FIG. 2, a preferred embodiment of the dome structure is illustrated showing a base 10 including concrete floor 11 with or without reinforcing bars embedded therein. The base includes a footing 12 to support the dome walls 13 of the structure.

Figure 3:
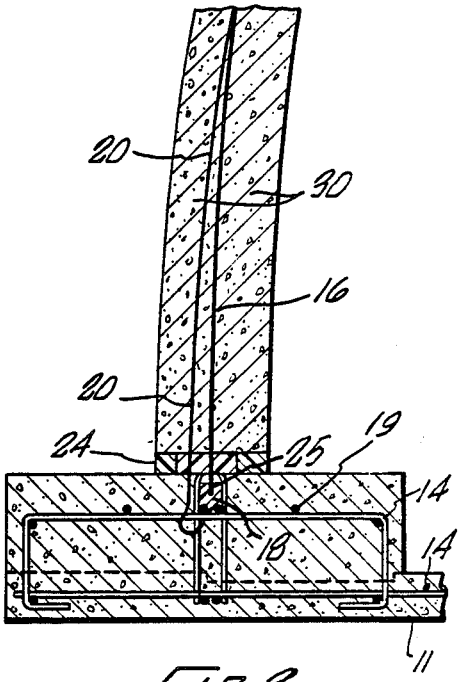
FIG. 3 is a cross-sectional view of another embodiment illustrating the connection of the composite dome walls to the base. In this embodiment, the dome walls do not curve inwardly near the base of the dome.

FIG. 2 shows the connection between the dome walls and the base which is magnified in greater detail in FIG. 3. As shown therein, the base 10 and integral footing 12 are reinforced circumferentially with number four galvanized bars (14). Membrane 16 is fastened to the base utilizing the holddown means 18 which include a key with epoxy fill.

The radial prestressing or reinforcing members 20 and their relationship vis-a-vis the membrane and base are also shown in FIG. 3 which illustrates how the radial prestressing members 20 are embedded into the concrete base 10 and hooked around radial reinforcing bars embedded in the floor slab. Radial prestressing or reinforcing members include but are not limited to steel wire, strip, seven-wire strand, wire rope or glass, carbon or other type fiber. The dome walls rest on a polyurethane pad 19 or the like, of a width sufficient to support the dome, but not so great as to cause large radial base restraints. Sponge rubber such as Rubatex 24 is used in the remaining portion of the joint, not occupied by the polyurethane pad. The purpose of the Rubatex is to insure adequate separation of the dome walls and the base with a minimum of restraint.

Figure 4:
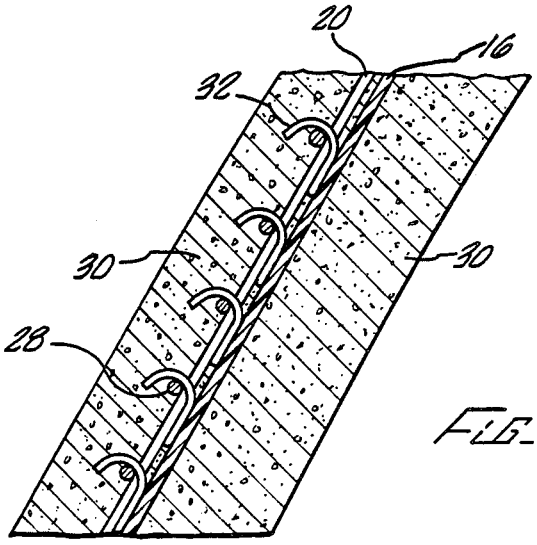
FIG. 4 is a cross-sectional view of the composite wall illustrating the membrane sandwiched between layers of rigidifying material with the radial and circumferential prestressing embedded therein. Spacers or hooks as well as stabilizing bars, integral with the radial prestressing, serve to position the circumferential prestressing and prevent it from moving to the top of the dome.

FIG. 4 shows how rigidifying material 30, such as shotcrete, concrete, fiberglass-reinforced epoxy, or other type of laminate, or a combination thereof is applied in circular layers to the inside and outside of the membrane 16 to form a composite wall of the required thickness. The membrane 16 is commonly made of a nylon-reinforced or polyester-reinforced vinyl, which is cut, spliced and sealed in a manner that it will inflate to the desired shape of the final dome configuration. This shape may be parabolic, round, elliptical or other, and is commonly symmetrical around the vertical axis of the shell. The membrane is securely fastened by epoxy fill 18 or the like to provide a tight seal between the dome walls and the base. The membrane is then inflated by air such that it pushes against the radial prestressing 20 to help form the desired shape.

Figure 6:
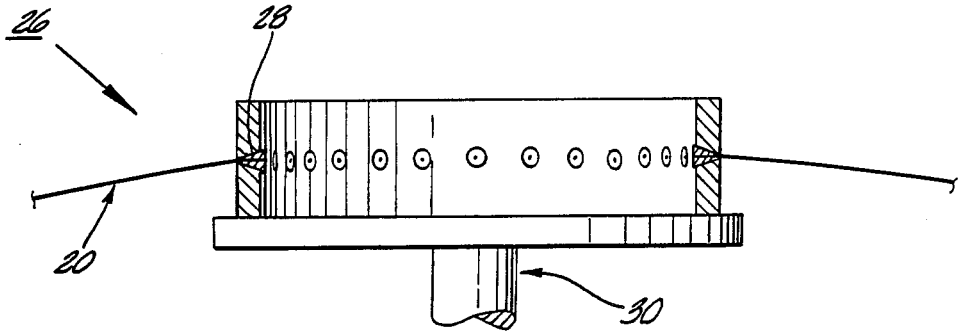
FIG. 6 is a partial cross-sectional view of the ring support which, in a preferred embodiment, holds the radial prestressing wire in place above the base of the structure. The ring support need not be supported by the post, but rather can be supported by the inflated membrane.
Figure 7:
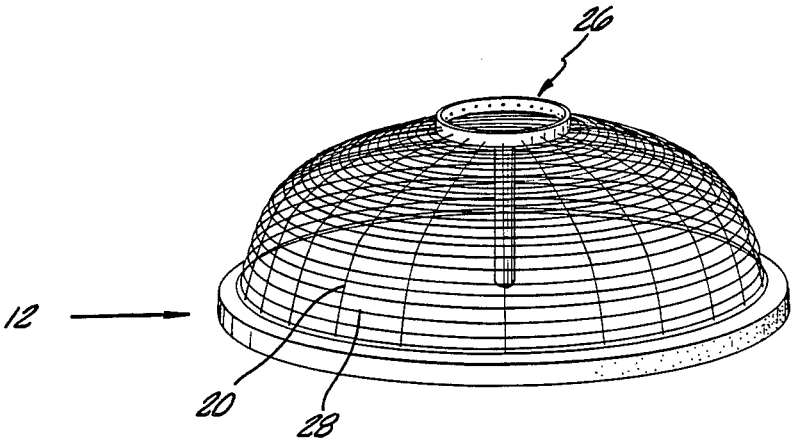
FIG. 7 is a perspective view of an embodiment of the claimed dome structure illustrating the interrelationship between the support ring, vertical and circumferential prestressing, membrane and footing of the structure.

In the preferred embodiment, radial prestressing wires are connected to a fastener such as the ring structure 26 in FIG. 6 which is preferably centered above the base of the structure. The ring 26 shown in FIG. 6 contains holes which receive and fasten the radial prestressing wires 20. The prestressing can be fastened using wedge anchors such as those illustrated by number 28. The ring support 26 can be positioned above the slab by a post 30 or by other suitable means, such as the air pressure in the membrane. The radial prestressing members are connected to such a ring, preferably located at the center of the dome structure. The wire prestressing extends from the ring 26 to the footing 12 of the structure. Each wire is capable of being adjusted or tensioned to help maintain the desired shape or configuration, minimize skin stresses in the fabric and ultimately provide radial prestressing to help contain the bursting force of the material stored within the dome structure.

Figure 5A:
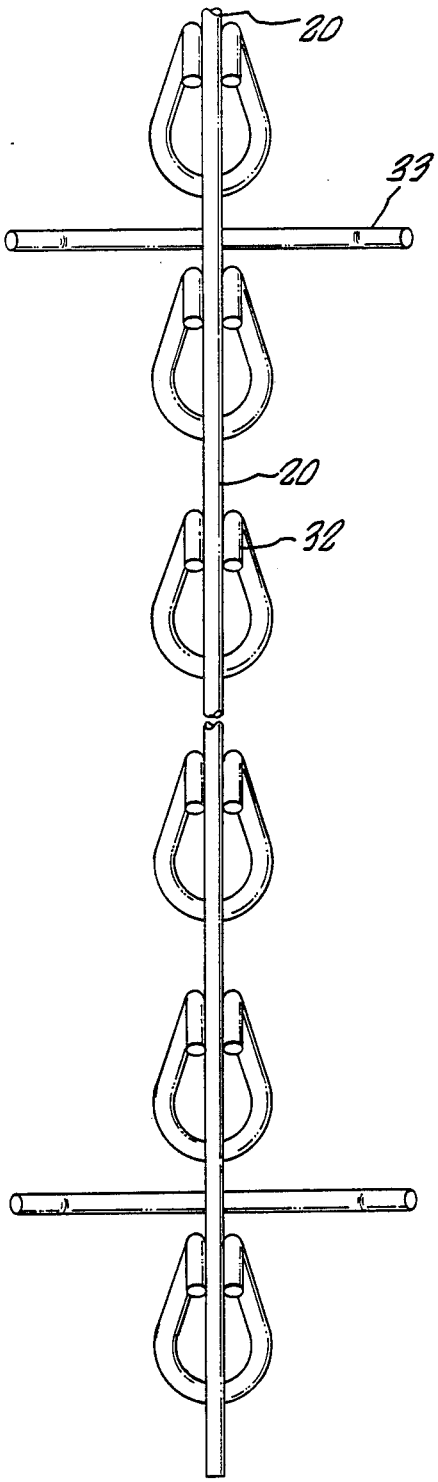
FIGS. 5A and 5B are cross-sectional views of the radial prestressing wire with cable spacers or hooks, as well as stabilizing bars, used to prevent circumferential prestressing from sliding up on the structure when tensioning is applied.
Figure 5B:
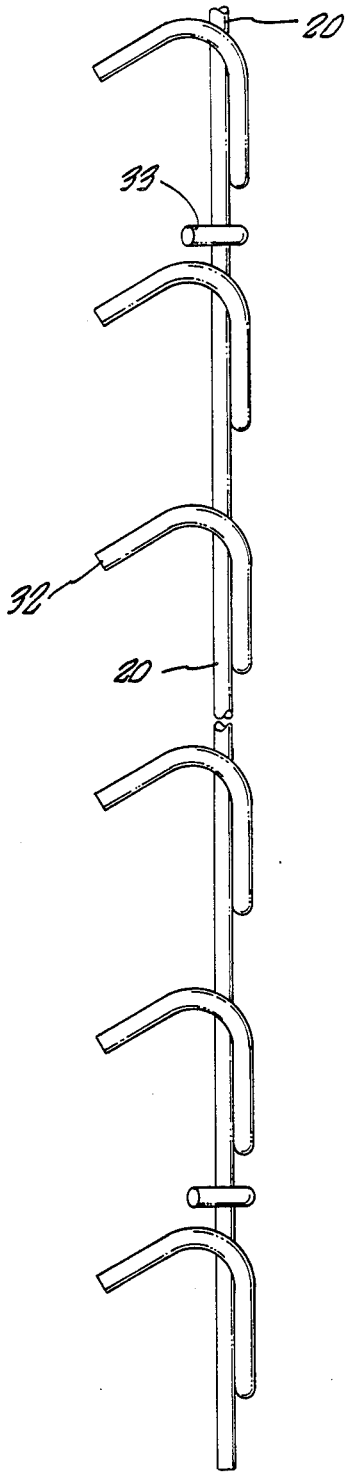

The radial prestressing 20 can include galvanized cable spacers or hooks 32 and stabilizing bars 33 as shown in FIGS. 5A and 5B. The cable spacers are attached and integral to the radial prestressing, such as wire 20, anchored to the footing 12 of the structure at one end and to the support ring 26 on the other. The cable spacers facilitate circumferential prestressing in that they can prevent the wrapped circumferential members, such as wires 28 (See FIG. 4), from sliding up on the dome surface. The cable spacers also help minimize circumferential arching of the membrane between the radial wires. The stabilizing bars 33 allow for proper positioning of the cable spacers or hooks vis-a-vis the membrane. Instead of cable spacers or hooks, the exterior shotcrete surface can also be stepped or keyed to accommodate the circumferential reinforcement.

The inside and outside of the membrane shall be sprayed with rigidifying material, such as shotcrete, 30 by manual or automated methods. Such methods as described in U.S. Pat. No. 3,572,596 and illustrated in the brochures relating to the subject structure which are provided herewith, all of which are incorporated herein reference. For shotcrete, either wet or dry mix material can be used.

Upon completion of the shotcreting process, the air pressure, which has caused the membrane to inflate to the desired shape, can be released causing the tensioned radial reinforcing to place the dome in compression. Additional compression in the dome wall is developed through the tension in the membrane.

After a sufficient amount of rigidifying material is placed on the outside surface, circumferential high tensile prestressing, such as wire strands, or fiberglass can be applied by machine or manual methods in sufficient quantities size and force to accommodate the design loads of the structure, so that the loading conditions of whatever material is stored in the structure are counteracted. In addition, compensation for differential temperature and drying stresses can also be accounted for. Such circumferential stressing can be applied utilizing the apparatus and techniques described in U.S. Pat. Nos. 3,572,596; 4,302,978; 4,302,979; 3,504,474; 3,510,041; 3,666,189 and 3,666,190; as well as set forth in the accompanying brochure filed herewith which illustrates the subject structure, the disclosure of all of which are incorporated herein by reference. Circumferential prestressing can be applied in multiple layers with rigidifying material, such as shotcrete or the equivalent, between each layer. It can also be placed in a single layer.

If additional radial wires or prestressing is required, it can be added over the circumferential prestressing, or shotcrete, or rigidifying material over-coat. If cable spacers or hook wires are not used, circumferential prestressing can be applied into slots, keyways or steps to prevent the circumferential prestressing from sliding up the dome surface.

Upon completion of the placement of all circumferential and/or radial reinforcement, shotcrete can then be applied manually or by automation over the outside reinforcement to provide the desired cover. A final paint, epoxy or other type of sealing material may be applied over the shotcrete shell.

In the preferred embodiment, the sequence of construction resulting in a dome structure according to the present invention is as follows.

A base 10 is constructed with or without an integral footing 12 as required. Regular or prestressed reinforcing rods 14 and 19 can be used to strengthen the base. Thereafter, the membrane is installed and sealed in slot 18 in the base. The ring 26 is then positioned centrally above the base, and radial prestressing members such as radial prestressed wires 20 are extended loosely between the base and ring. The prestressing wires are connected to the footing on one end and on the other end to the ring. They are fastened to the ring by wedge anchors 28.

The next step involves the inflation of the membrane, tailored to form the desired shape, within the radial prestress wires which applies tension to the radial prestress wires and provides the desired form, which in the preferred embodiment is elliptical in shape.

Rigidifying materials such as shotcrete is then applied both above and above the membrane, embedding the membrane and radial prestressing wires therein. Once the shotcrete has partially cured, the air which caused the membrane to expand to the desired range is released. The concrete is therefore placed in compression and a self-sustaining dome is formed. The membrane is not removed but remains imbedded in the concrete forming a seal or waterstop and preventing the dome structure from leaking.

If circumferential prestressing is desired, cable spacers 32 can be used with the radial prestressing. Wires containing these cable spacers can be interspersed throughout the structure. The cable spacers position and prevent the circumferential prestressing cable from riding up on the structure. Further layers of shotcrete, epoxy or sealer can be placed on top of the circumferential prestressing.

Once circumferential prestressing is accomplished, a structure has been created which is capable of withstanding sustantial internal pressure from the containment of liquids gases and the like.

Thus, an improved dome structure is disclosed. While the embodiments and applications of this invention have been shown and described, it would be apparent to those skilled in the art that many more modifications are possible without departing from the inventive concepts herein. The invention therefore is not to be restricted except in the spirit of the appended claims.

What is claimed is:

1. A method for forming a dome structure of a desired shape with walls of sandwich composite construction on a base comprising the steps of:

(a) locating on said base a membrane which when inflated will form the desired shape;

(b) placing flexible radial prestressing members tailored to help form the desired shape adjacent and outwardly to said membrane;

(c) pressurizing said membrane to force the membrane tightly against said prestressing members to the desired shape;

(d) applying a first layer of rigidifying material inwardly of said membrane;

(e) applying a second layer of rigidifying material outwardly of said membrane and around said flexible prestressing members;

(f) circumferentially prestressing said dome structure by circumferentially wrapping flexible prestressing material around said structure under tension.

2. The method claimed in claim 1 wherein the prestressing members include means to hold the circumferential prestressing members in place and prevent them from riding up the dome of said dome structure.

3. The method claimed in claim 1 wherein the steps are to be performed in sequence.

4. The method claimed in claim 1 wherein the prestressing members comprise flexible radial wires.

5. The method in claim 1 wherein the rigidifying material is shotcrete.

6. The method in claim 1 wherein the rigidifying material is fiberglass.

7. The method in claim 1, having the added step of tailoring the membrane to form the inward curvature near the base's periphery.

8. The method in claim 1, having the added step of shaping the membrane so that the circumference of the dome cross section begins decreasing at a certain distance above the base to form an inward curvature near the base where it is connected to the footing.

9. The method in claim 7 regarding the inward curvature near the base, having the added step of applying additional layers of rigidifying material outwardly of said curved membrane to increase the thickness of the dome near the bases' periphery.

10. The method in claim 7 wherein the inward curvature of the walls of the dome near the base's periphery is positioned below the surface level of backfill.

11. The method in claim 1 having the added step of shaping the membrane to create an inward curvature of the dome walls near the periphery of the base, to facilitate downward pressure on the dome by the contents of the dome.

12. A method for forming a composite sandwich dome structure comprising the steps of:

a. constructing a base;

b. forming a flexible liquid-impervious membrane which when inflated will conform to a desired shape, and attaching it to said base;

c. attaching flexible radial prestressing members to said base, said flexible radial prestressing members designed to help form the desired shape, and placing them outwardly to said membrane, said radial prestressing members also having adjustable spacing and restraining means for engaging circumferential prestressing;

d. pressurizing said membrane and causing it to inflate against said flexible radial prestressing members and causing both the membrane and prestressing members to form the desired shape;

e. applying a first layer of rigidifying material to the inside of said flexible membrane;

f. applying a second layer of rigidifying material outside of said membrane to coat said radial prestressing members;

g. applying circumferential tensioned wrapping over said structure, which circumferential wrapping is prevented from sliding up the dome by the spacing and restraining means attached to said radial prestressing members;

h. further applying protective layers of rigidifying material to said circumferential wrapping;

i. wherein a composite sandwich dome structure is formed which is leakproof because the membrane is retained in the structure.

13. The method of claim 12 wherein the radial prestressing is held together at the apex by a ring fastener at the center of the structure which adjustably holds but allows each prestressing member the capability of being adjusted or tensioned to define a desired shape.

14. The method of claim 12 having the added step of tailoring the membrane to form an inward curvature near the base's periphery.

15. The method in claim 14 having the added step of applying additional layers of rigidifying material outwardly of said curved membrane to form an increased thickness of the dome wall near the base's periphery.

16. The method in claim 14 wherein the inward curvature at the base's periphery is positioned below the surface level of backfill.

17. The method in claim 12 wherein the steps are to be performed in sequence.

18. A method for forming a dome structure on a base comprising the steps of:

(a) extending radial prestressing members from said base, tailored to help form a desired shape;

(b) positioning said prestressing members above said base;

(c) positioning a liquid-impervious membrane tailored to form a desired shape inwardly to the prestressing members;

(d) inflating said membrane to cause the radial prestressing to assume the desired shape (e) applying a first layer of rigidifying material inwardly of the membrane;

(f) applying a second layer of rigidifying material outwardly of said membrane and around said radial prestressing members.

19. The method in claim 18 wherein the steps are to be performed in sequence.

20. The method of claim 18 with the additional step of forming an inward curvature of the membrane near the base's periphery.

21. The method of claim 18 with the additional step of circumferentially prestressing said dome structure by wrapping circumferential prestressing material around said structure.

22. The method in claim 21 wherein the radial reinforcing members include cable spacers to aid in circumferential prestressing.

23. The method in claim 18 wherein the rigidifying material is shotcrete.

24. The method of claim 18 wherein the rigidifying material is fiberglass.

25. The method of claim 21, with the added step of forming an inward curvature of the dome wall near the base;

26. The method in claim 25 having the added step of applying additional layers of rigidifying material outwardly of said curved membrane to form an increased thickness;

27. The method in claim 25 wherein the inward curvature of the walls is positioned below the surface level of backfill.

28. The structure in claim 18 wherein the base is provided with a key and the membrane is fastened to the base by insertion into said key and sealed with sealer.

29. The method of claim 18, wherein the dome structure rests on a rubber bearing pad positioned between the dome structure and the base to minimize radial bending stresses.

30. A process for constructing a tank structure of composite construction on a base supported by a foundation comprising the steps of:

(a) attaching on said base a membrane;

(b) placing flexible radial prestressing outwardly of said membrane;

(c) inflating said membrane to define a shape;

(d) applying a composite layer of rigidifying material inwardly of said membrane;

(e) applying a composite layer of rigidifying material outwardly of said membrane;

(f) selecting an anticipated storage load.

(g) placing said rigidifying material in compression which substantially equals said anticipated storage loads.

31. The process claimed in claim 30 wherein the step of prestressing the outside of the tank structure includes circumferential prestressing by wrapping material around said rigidifying material.

32. The process in claim 30 wherein said rigidifying material consists at least in part of reinforced plastic.

33. The process in claim 32 wherein the reinforcing of said reinforced plastic consists at least in part of synthetic fibers.

34. The process in claims 32 wherein the reinforcing of said reinforced plastic consists at least in part of steel fibers.

35. The process in claim 30 wherein the material used for compressing said rigidifying material consists at least in part of steel.

36. The process in claim 30 wherein the material used for compressing said rigidifying material is at least in part synthetic.

37. The process in claim 30 wherein said rigidifying material consists at least in part of cementious materials.

38. The process in claim 37 wherein said cementious materials contain at least in part portland cement.

39. The process in claim 37 wherein said cementious materials contain at least in part aggregates.

40. The process in claim 30 wherein said rigidifying material at least in part consists of polymer concrete.

41. The process in claim 30 wherein said tank structure on said base is an axis symmetric curved surface.

42. The process in claim 41 wherein said axis symmetric curved surface is elliptical in section.

43. The process in claim 41 wherein said axis symmetric curved surface is parabolical in section.

44. The process of claim 41 wherein said axis symmetric curved surface is circular in section in any plane revolved around the axis of rotation.

45. The process in claim 30 wherein a portion of said base consists of at least a floor.

46. The process in claim 30 wherein a portion of said foundation consists of at least one footing.

47. The process in claim 30 in which said inflated membrane is prefabricated and preshaped.

48. The process in claim 30 in which said inflated membrane has anchoring means to said foundation.

49. The process in claim 30 in which said anchoring means include at least bolts or hooks.

50. The process in claim 30 in which the membrane is attached to a base which includes a concrete ring footing for uplift prevention.

51. The process in claim 30 in which the membrane is attached to said base by uplift prevention means comprising screw anchors drilled into the foundation.

52. The process in claim 30 in which the membrane is attached to said base by uplift prevention means comprising a circular slot in which said membrane is placed and contained by clamping means.

* * * * *